United States Patent [19]

Gray

[11] Patent Number: 4,745,678

[45] Date of Patent: May 24, 1988

[54] APPARATUS FOR BELLING AND EXPANDING COILS

[75] Inventor: Kenneth P. Gray, Syracuse, N.Y.

[73] Assignee: Carrier Corporation, Syracuse, N.Y.

[21] Appl. No.: 944,489

[22] Filed: Dec. 22, 1986

[51] Int. Cl.[4] ..... B23P 15/26

[52] U.S. Cl. ..... 29/727; 29/157.3 C; 29/523

[58] Field of Search ..... 29/726, 727, 157.36, 29/157.4, 523, 33 G, 33 T; 72/370, 367

[56] References Cited

U.S. PATENT DOCUMENTS

| | | | |
|---|---|---|---|
| 3,824,668 | 7/1974 | Wightman | 29/727 |
| 4,584,751 | 4/1986 | Gray et al. | 29/727 |
| 4,584,765 | 4/1986 | Gray | 29/727 |
| 4,589,198 | 5/1986 | Greever et al. | 29/727 |
| 4,631,813 | 12/1986 | Daniels | 29/727 |

*Primary Examiner*—Howard N. Goldberg
*Assistant Examiner*—Irene Cuda
*Attorney, Agent, or Firm*—Robert H. Kelly

[57] ABSTRACT

A method and apparatus for belling and expanding the tubes of a plate fin heat exchanger that involves a gripper for gripping the tube during the belling operation and a clamp for clamping a tube sheet during the tension expanding operation.

3 Claims, 3 Drawing Sheets

APPARATUS FOR BELLING AND EXPANDING COILS

BACKGROUND OF THE INVENTION

This invention relates generally to heat exchanger coils and, more particularly, to an apparatus for the belling and expanding of plate fin heat exchanger coils in tension expansion for controlling the dimension of the bell and tube length.

A plate fin heat exchanger coil is commonly constructed with a plurality of flat, parallel plates having laterally spaced holes therein for receiving refrigerant tubes, or hairpin tubes, therein. At each end of the plate fin bundle, there is a tube sheet composed of heavier material, and adjacent one of the tube sheets, the open ends of the hairpin tubes are fluidly connected by way of U-shaped return bends that are secured thereto by way of soldering, brazing, or the like. When the coils are installed into a refrigeration system, the refrigerant is made to flow through the hairpin tubes, and the air to be cooled or heated is made to flow over the plate fins, such that a heat transfer is thereby affected.

As is known, the tube compression expansion process is generally carried out by passing tube expanding rods through the open ends of the hairpin tubes and then belling the tube. A backing plate is placed against the tube bends during compressive expansion to prevent the tubes from being driven out of the unit as the expanding tools are forced therethrough. As a result of this holding action the tubes are compressed rearwardly as they are being expanded outwardly by the tools. This in turn, causes the tubes to shrink so that the axial length of each tube can vary dramatically in final assembly. Because of the differences in tube length, belling of the tubes is difficult and generally results in uneven or misaligned bells being formed in the tube ends. The return bend therefore cannot be properly seated within the bells leading to the formation of relatively weak or incomplete solder o braze joints in this critical region.

In order to better facilitate the formation of the tube bells and the joining of the return bends therein, it has been the common practice in the art to bring the open ends of the hairpins a considerable distance out from the adjacent tube sheet. The additional length of tube allows each bell to be brought to full depth without interference from the tube sheet. The unsupported length of tube between the bell and the tube sheet, however, represents the weakest section in the unit. Hydrostatic tests have shown that the flow circuit will generally rupture in this region when exposed to high internal stresses. Beyond weakening the unit the added length of tubing wastes costly material and thus raises the cost of each unit. Furthermore, the added tube length makes it difficult to compact the unit which in the case of a room air conditioner is of primary importance. In order to improve the hydrostatic burst strength of a plate fin heat exchanger, a technique for tension expanding hairpin tubes into a fin pack unit, as explained in greater detail in U.S. Pat. No. 4,584,765 was developed. This prior technique was generally carried out on a three row coil which was first belled by a split collet and pin arrangement, and then expanded. Because of the closeness of the heat exchanger tube rows the bells that were formed are simple, single diameter be11s, to which pretinned return bends are nested. Further, because of the closeness of the heat exchanger tube rows, the jaw members of the tube clamping fixture were relatively long, thin members. In operation, however, these long, thin jaw members bowed or bent during the expansion process. Furthermore, the single diameter bell was not suitable for ultrasonic soldering, but had to use pretinned return bends. Thus, to use ultrasonic soldering, the bell diameter would have had to be increased, which would have required even less space between adjacent tubes, making the jaw member even thinner and subject to more bowing in the horizontal direction.

A further disadvantage of the prior tension expansion process is that a heat exchanger unit is first belled at one station, and then the belled unit is conveyed and indexed into another station to be expanded. As a consequence, the manufacture of the plate fin heat exchanger is time consuming and costly.

Thus, there is a clear need for a simple belling and tension expanding apparatus which eliminates the need for belling a coil at the station and then moving the coil to another station for expansion.

SUMMARY OF THE INVENTION

It is an object of the present invention to simplify the manufacture of plate fin heat exchanges.

It is another object of the present invention to reduce the manufacturing cost of a plate fin heat exchanger.

It is a further object of the present invention to bell and then tension expand plate fin heat exchanger coils at one station.

It is still another object of the present invention to provide a safe, economical, and reliable method of belling then expanding a coil and an apparatus for expanding and belling a plate fin heat exchanger at one station.

These and other objects of the present invention are attained by a method of belling and then tension expanding a plate fin coil at a single station during the manufacturing process. The method includes extending the tubes from the coil a selected distance, advancing the expander assembly to locate the expanding bullet in engagement with the tube, gripping the tube in a gripper means, actuating a belling means to bell the end of the tube, releasing the gripper means and clamping a tube sheet in a clamp means, and actuating an expansion means whereby the belled portion of the tube is seated against the tube sheet and the tube is expanded in tension.

An integrated beller/expander apparatus for tension expansion is further disclosed including a gripper means for gripping a selected portion of the end of a tube extending beyond a tube sheet, a belling means for belling the end of a tube, a clamping means for clamping the tube sheet while releasing the gripper means, and expanding means for seating the bell of the tube into the clamped tube sheet and expanding the tube in tension expansion.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification, and in which reference numerals shown in the drawings designate like or corresponding parts throughout the same, and in which.

DESCRIPTION OF THE PREFERRED EMBODIMENT

Figure 1:
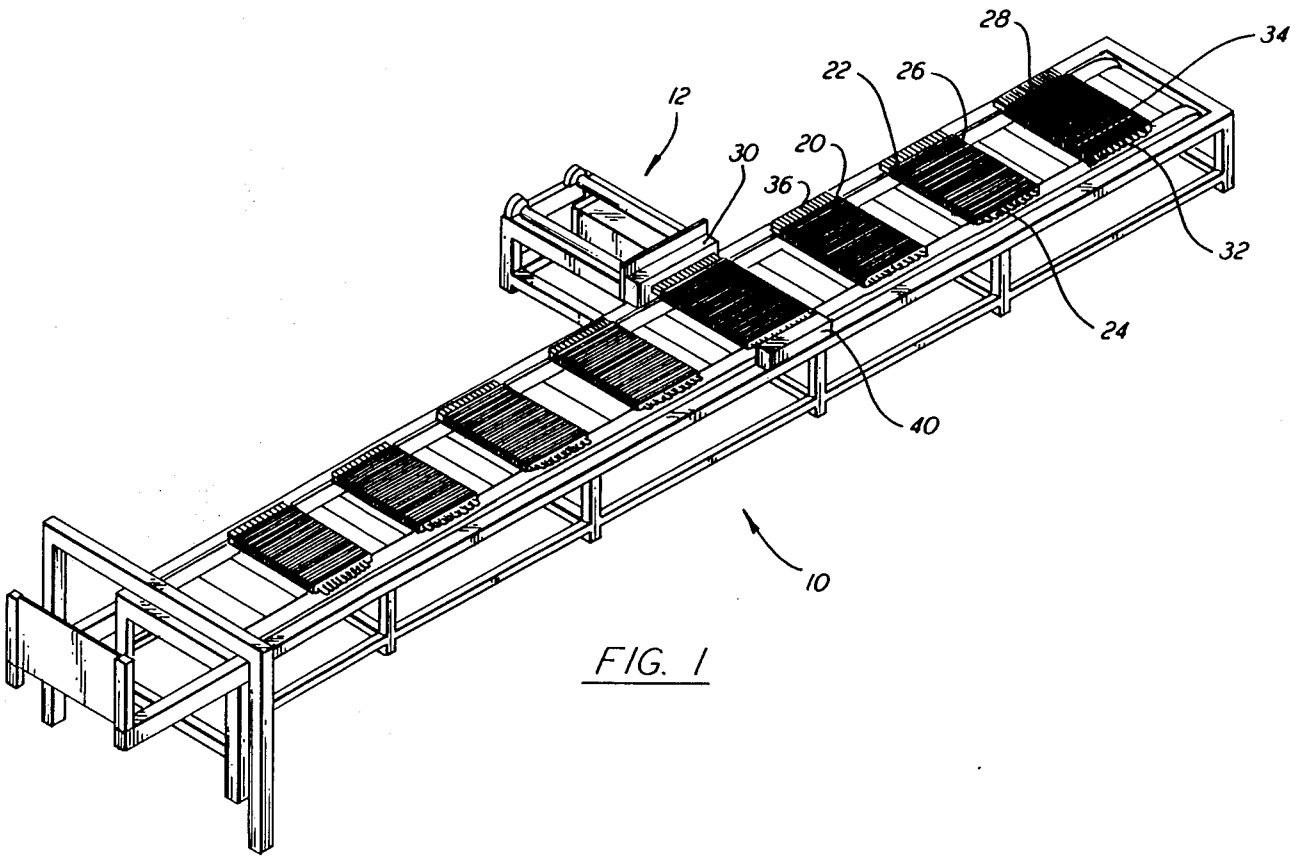
FIG. 1 is a perspective view of a portion of a plate fin coil assembly apparatus embodying the teachings of the present invention.

Referring to FIG. 1, there is shown a portion of a plate fin heat exchanger system 10 with the various components used in accordance with the apparatus of the present invention. The embodiment of the plate fin coil beller/expander herein will be described in connection with beller/tension expander station 12. Prior to arriving at the expander station 12, the plate fin heat exchanger 20 is partially assembled at a lacing station (not shown). It is to be understood that a plate fin heat exchanger has a plurality of fins 26, a bottom tube sheet 24, and a top tube sheet 22. Hairpin tubes 28 are arranged having bend end portions 32 and leg portions 34 such that the leg portions extend through tube sheet 24 and the entire fin bundle to tube sheet 22 and extend beyond tube sheet 22 defining extension portions 36. The hairpin tubes are physically inserted or laced through arranged openings in the fins and tube sheets into the positions as shown.

The integrated beller/expander station shown in FIG. 1 includes expander assembly 30 for gripping, belling, and expanding the hairpin tubes, and bend end receiver 40 which are adapted to matingly engage with the bend end portion 32 of the hairpin tubes to ensure that all of the tube ends will be evenly displaced within the expander assembly 30 if there are any differences in the lengths of the hairpin tubes.

Figure 2:
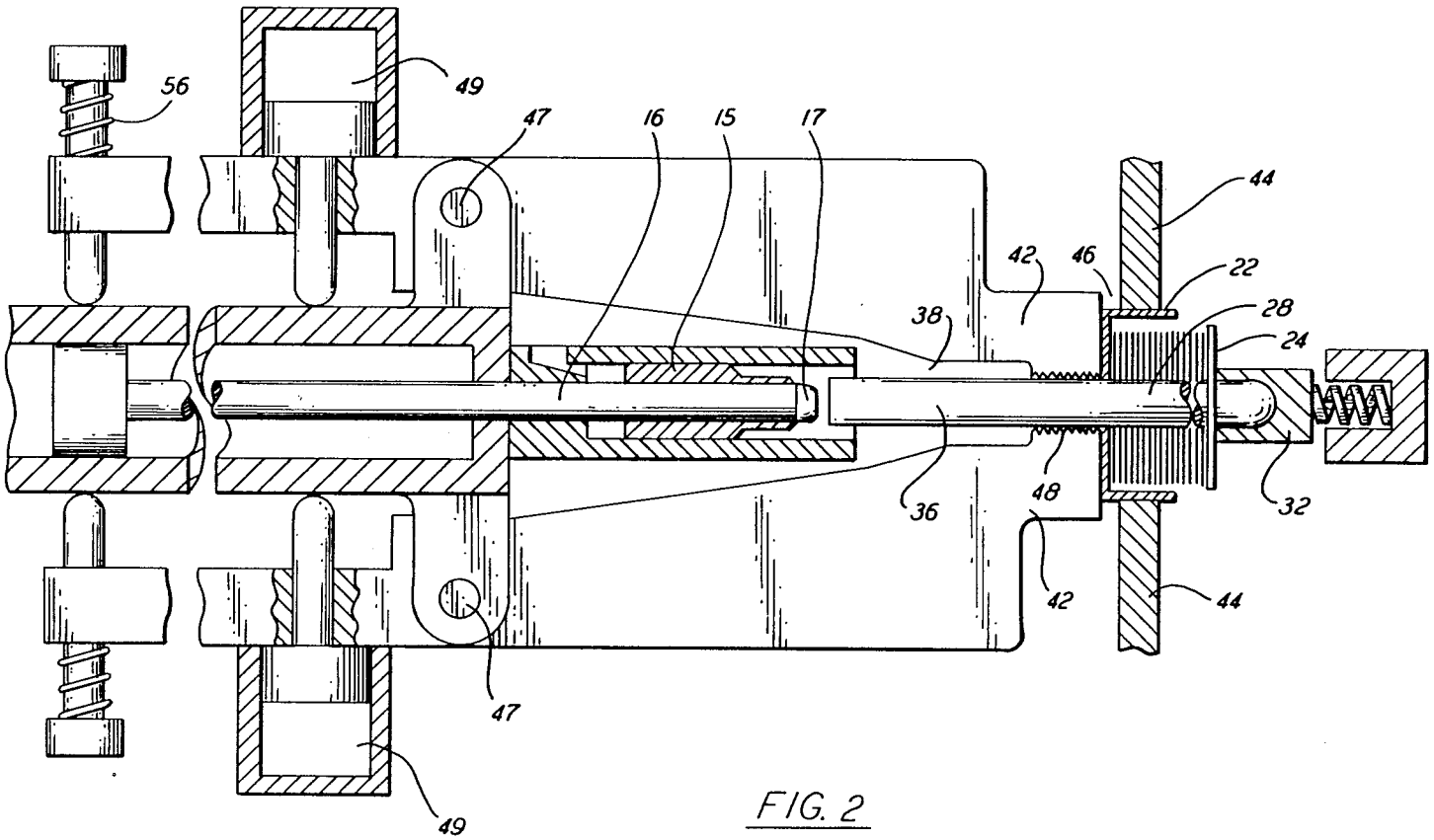
FIG. 2 is an enlarged side elevation view partly broken away showing the belling/expander assembly of the present invention gripping the tube.
Figure 3:
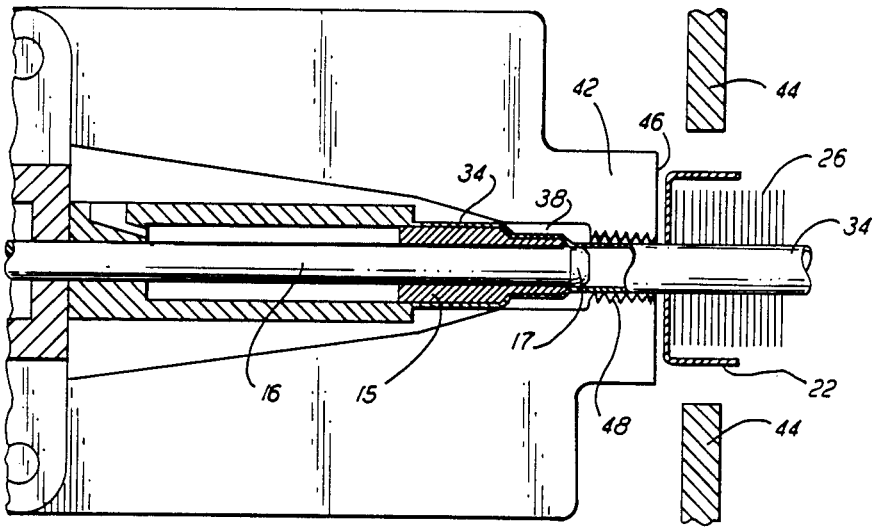
FIG. 3 is an enlarged side elevation view partly broken away showing the belling/expanding assembly of FIG. 2 after the tube has been belled.
Figure 4:
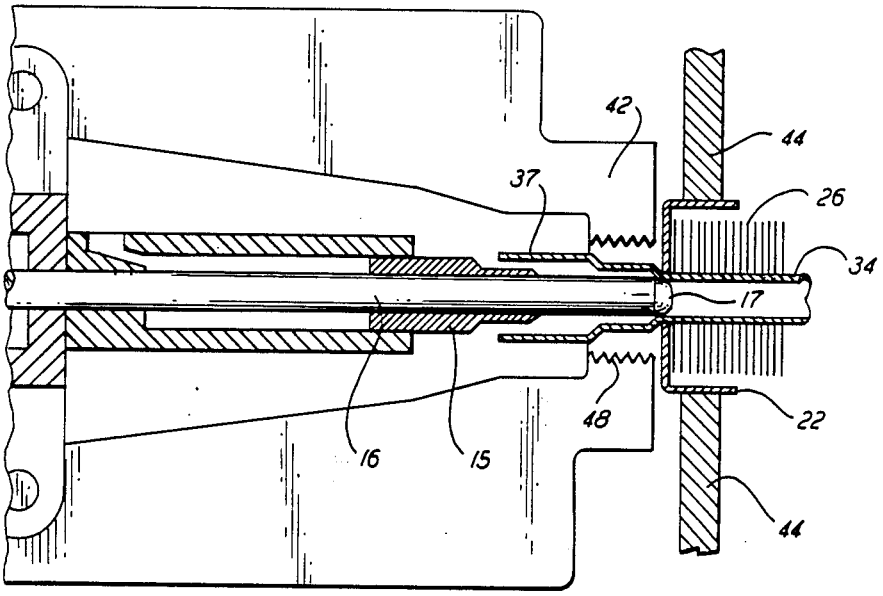
FIG. 4 is an enlarged side elevation view partly broken away showing the belling/expanding assembly of FIG. 3 during the tension expansion stroke.

Turning now to FIGS. 2-4 there is shown a single tube of the plate fin heat exchanger 20 during the belling and expanding operation of the present invention. The tube is held within the expander station 12 by means of bend end receiver 40 which is adapted to act against the bend end portion 32 of the tube, and a pair of movable jaw members 42—42 pivotable about pins 47—47 which contact the tube during the belling operation and movable clamp means 44—44 which contacts the top tube sheet 22 during the tension expansion operation. Further, the expander assembly 30 includes a bullet rod 16 having an expansion bullet 17 mounted on the end of the bullet rod and having an outside diameter greater than the inside diameter of the tube, and a beller tool 15 slidable on the bullet rod 16 such that the beller tool 15 initially provides the appropriate bell portion 37 and subsequently the bullet rod 16 having an expansion bullet 17 mounted on the end of the bullet rod and having an outside diameter greater than the inside diameter of the tube is actuated to expand the full length of the interior of the tube in tension expansion. The actuation of the expander assembly 30 can be accomplished by any known system, e.g. a hydraulic system 49—49.

In operation, with the plate fin heat exchanger 20 indexed within the expander station 12, the bend end receiver 40 moves against the bend end portion 32 of the hairpin tube 28 while movable clamp means 44 is clamped on top tube sheet 22. The bend end portion 32 provides sufficient force to compress the plate fin heat exchanger 20 so that the extension portion 36 of the hairpin tube 28 extends beyond the gripper means 48, e.g. serrated teeth, of movable jaw members 42 into bell expanding void 38. After the extension portion 36 is moved within bell expanding void 38 the movable jaw members 42 are actuated to close around a portion of the tube to secure the tube against movement as the beller tool 15 is actuated so that the extension portion 36 is belled in compression belling in the bell expanding void 38. With the extension portion 36 now formed into bell portion 37 the movable jaw members 42 are opened, for example by biasing means 52, as shown in FIG. 4, whereby the bullet rod 16 is moved to drive the expansion bullet 17 against the unexpanded tube so that the bell portion 37 engages the top tube sheet 22, and the bullet rod 16 continues to move the expansion bullet 17 through the hairpin tube 28 by tension expansion until the entire tube is expanded. After the tubes have been expanded into locking engagement with the fins and tube sheets the bullet rod 16 is retracted and the movable clamp means 44 is placed in an open position and the belled and expanded plate fin heat exchanger is removed from the expander station.

While a preferred embodiment of the present invention has been depicted and described it will be appreciated by those skilled in the art that many modifications, substitutions, and changes may be made thereto without departing from the true spirit and scope of the invention.

What is claimed is:

1. An apparatus for belling tubes and then expanding the tubes in tension of a plate fin heat exchanger having a plurality of apertured plate fins parallelly spaced between two apertured tube sheets and a plurality of hairpin tubes extending through the apertures comprising:

a gripper means for gripping an open end of the hairpin tube;

a beller means for belling said open end of the hairpin tube; said beller means slidable along a support rod and said support rod movably positioned within said gripper means;

an expander means attached to an end of said support rod for expanding the tube; and a clamp means for clamping a tube sheet proximate the open end of the tube whereby the gripper means grip the tube to prevent the tube from moving during a belling operation and whereby said clamp means clamps said tube sheet proximate the open end of the tube to allow the belled end of the tube to move axially against said tube sheet and to restrain the tube from moving during expansion of the tube in tension expansion.

2. The apparatus as set forth in claim 1 wherein said gripper means includes a pair of pivotal jaw pairs for frictionally gripping the tube.

3. The apparatus as set forth in claim 2 wherein said pair of pivotal jaw pairs include serrated teeth for frictionally gripping the tube.

* * * * *